US010041265B2

(12) United States Patent
Uy et al.

(10) Patent No.: US 10,041,265 B2
(45) Date of Patent: Aug. 7, 2018

(54) MULTI-POSITION VALVE ACTUATORS

(71) Applicant: ZODIAC POOL SYSTEMS, INC., Vista, CA (US)

(72) Inventors: Dindo Uy, North Hollywood, CA (US); Eusebio Domingo Bareng, Vista, CA (US)

(73) Assignee: ZODIAC POOL SYSTEMS LLC, Vista, CA (US)

( * ) Notice: Subject to any disclaimer, the term of this patent is extended or adjusted under 35 U.S.C. 154(b) by 392 days.

(21) Appl. No.: 14/014,660

(22) Filed: Aug. 30, 2013

(65) Prior Publication Data

US 2014/0060656 A1 Mar. 6, 2014

Related U.S. Application Data

(60) Provisional application No. 61/695,465, filed on Aug. 31, 2012.

(51) Int. Cl.
*E04H 4/12* (2006.01)

(52) U.S. Cl.
CPC ..... *E04H 4/12* (2013.01); *E04H 4/1209* (2013.01); *Y10T 137/0318* (2015.04); *Y10T 137/86389* (2015.04)

(58) Field of Classification Search
CPC ..... G06F 19/00; F16K 37/00
USPC ..... 137/553–554; 251/129.01, 129.04; 73/168
See application file for complete search history.

(56) References Cited

U.S. PATENT DOCUMENTS

| | | | | |
|---|---|---|---|---|
| 4,782,333 | A * | 11/1988 | Merchant | 340/610 |
| 5,009,075 | A * | 4/1991 | Okoren | 62/127 |
| 5,564,677 | A * | 10/1996 | Levy et al. | 251/129.12 |
| 5,856,743 | A * | 1/1999 | Juniman | 324/207.25 |
| 6,176,247 | B1 * | 1/2001 | Winchcomb et al. | 137/14 |
| 6,920,409 | B2 * | 7/2005 | Essam | F16K 37/0091 702/113 |
| 8,074,512 | B2 * | 12/2011 | Al-Buaijan | 73/168 |
| 8,262,060 | B2 * | 9/2012 | Heer et al. | 251/129.04 |
| 8,579,252 | B2 * | 11/2013 | Heer | 251/129.04 |
| 8,607,645 | B2 * | 12/2013 | Laubach et al. | 73/861.76 |
| 2003/0107015 | A1 * | 6/2003 | Mianzo et al. | 251/129.04 |
| 2004/0250861 | A1 * | 12/2004 | Schnell et al. | 137/599.08 |
| 2006/0032535 | A1 * | 2/2006 | Madden | 137/554 |
| 2006/0032536 | A1 * | 2/2006 | Galloway et al. | 137/554 |
| 2006/0236513 | A1 * | 10/2006 | Sandhu et al. | 29/25.01 |
| 2009/0306830 | A1 * | 12/2009 | Cummings et al. | 700/282 |
| 2010/0037966 | A1 * | 2/2010 | Braun et al. | 137/554 |
| 2010/0089473 | A1 * | 4/2010 | Grein et al. | 137/553 |
| 2010/0187456 | A1 * | 7/2010 | Heer et al. | 251/129.03 |
| 2010/0315069 | A1 * | 12/2010 | Heer et al. | 324/207.11 |

(Continued)

OTHER PUBLICATIONS

Jandy Valve Actuator Installation Manual, Apr. 2008.*

*Primary Examiner* — Craig Schneider
(74) *Attorney, Agent, or Firm* — Kilpatrick Townsend & Stockton LLP; Dean W. Russell

(57) ABSTRACT

Detailed are actuators especially useful in connection with valves forming parts of water-recirculation systems of pools or spas. Transit times of components of the actuators may be measured or otherwise determined and signals sent to the actuators to cease movement of the components between boundary positions. Consequently, dynamic adjustment of the valving capabilities of the systems may be achieved.

2 Claims, 1 Drawing Sheet

(56) References Cited

U.S. PATENT DOCUMENTS

| | | | | |
|---|---|---|---|---|
| 2011/0114191 | A1* | 5/2011 | Wheater | F16K 37/0091 137/12 |
| 2011/0126637 | A1* | 6/2011 | DeWall et al. | 73/861.75 |
| 2011/0180165 | A1* | 7/2011 | Hansson et al. | 137/554 |

* cited by examiner

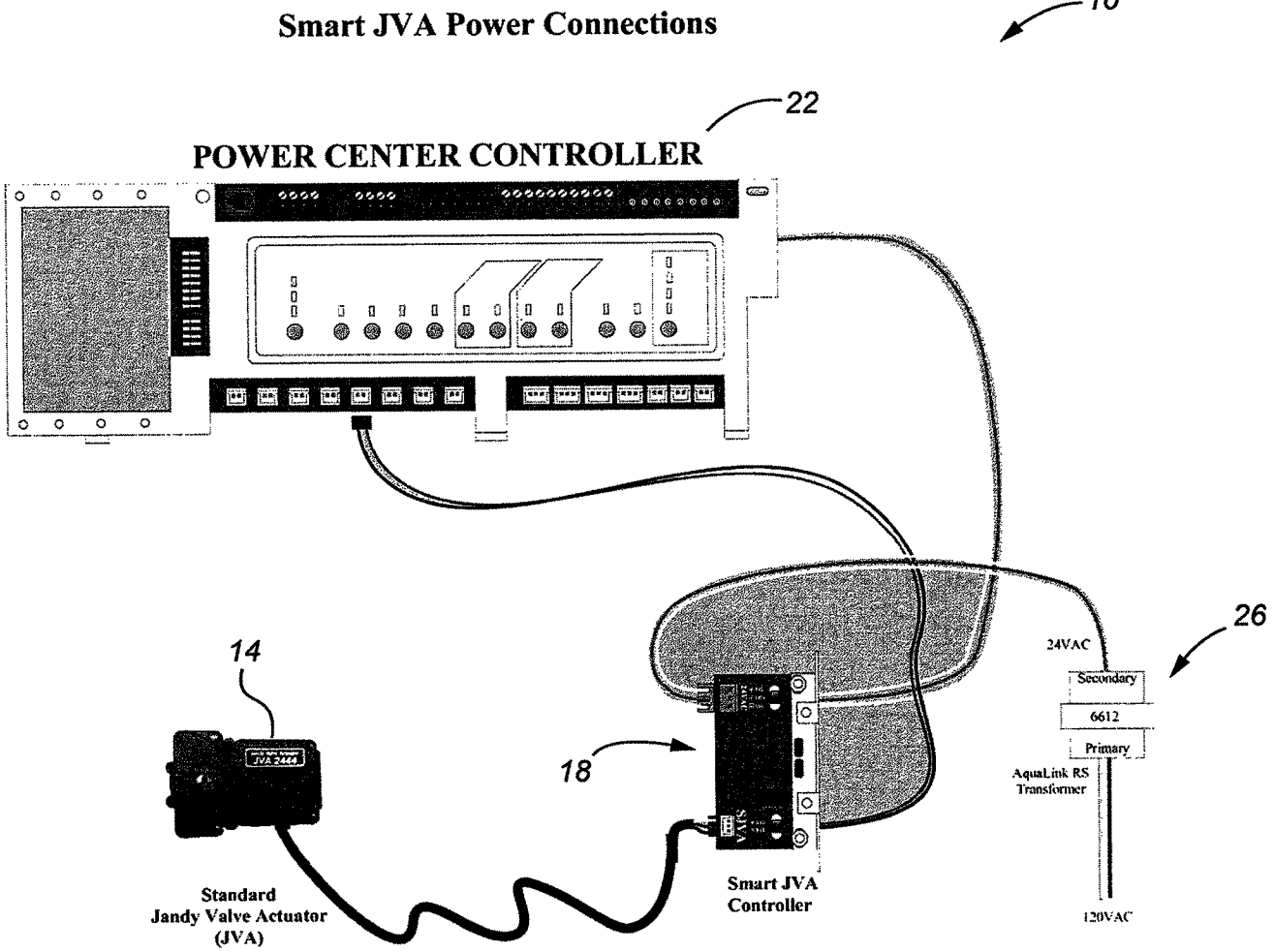
Smart JVA Power Connections
10
22
POWER CENTER CONTROLLER
26
24VAC
Secondary
6612
Primary
AquaLink RS Transformer
120VAC
Smart JVA Controller
SJVA
18
14
Standard Jandy Valve Actuator (JVA)

MULTI-POSITION VALVE ACTUATORS

CROSS-REFERENCE TO RELATED APPLICATION

This application claims the benefit of U.S. Provisional Patent Application Ser. No. 61/695,465, filed Aug. 31, 2012, and having the same title as appears above, the entire contents of which application are incorporated herein by this reference.

FIELD OF THE INVENTION

This invention relates to actuators and more particularly, although not necessarily exclusively, to multi-position actuators especially useful in connection with valves forming parts of water recirculation systems of pools or spas.

BACKGROUND OF THE INVENTION

Two-position valve actuators exist. One, known as the Jandy Valve Actuator ("JVA") and sold by the assignee of this application, uses two cams to set the two positions. The cams may be adjusted manually following disassembly of the JVA, as may occur during installation of the actuator. No means of adjusting the cams dynamically during operation of the JVA exists, however, nor is there any way of stopping the JVA at a position other than the two positions created by the pre-set cams.

Multi-position valve actuators likewise exist. Generally, though, these actuators are complex and expensive, often employing closed-loop control not necessarily needed in pools and spas. These complex actuators additionally are difficult to integrate into existing automation systems of pools and spas.

BRIEF DESCRIPTION OF THE DRAWING

The FIGURE is a schematic representation of a system consistent with the present invention.

DESCRIPTION OF THE INVENTION

Need thus exists for multi-position actuators of low cost and less complexity than current offerings. Such actuators may be obtained by coupling a JVA to an electronic controller able to measure transit time of the JVA from the first position to the second position. If the first and second positions are selected to be maximum ("hard limit") travel boundaries of the cams, transit time may be calibrated to the change in position between the boundaries. Hence, the controller may stop the JVA at any position between the boundaries by measuring the elapsed travel time and signaling cessation of movement at the appropriate time.

The Jandy AquaLink device, a pool digital assistant ("PDA") or other device may function as the electronic controller. Portions of the control may be embedded in firmware on a printed circuit board ("PCB") or otherwise if desired. The actuators thus may be easy to install and "backwards compatible" for purposes of retrofitting existing equipment. The actuators additionally may be modular if desired, in that an installer may install as many PCBs as needed to control the number of JVAs available. In some versions of the invention each JVA will have a dedicated PCB, although a 1:1 correspondence between JVAs and PCBs is neither necessary nor always necessarily desirable.

Illustrated in the attached FIGURE (entitled "Smart JVA Power Connections") is a schematic representation of a system 10 including a multi-position JVA 14. Shown as electrically connected to actuator 14 is controller 18, which may be or include a firmware-containing PCB. Also shown is power center controller 22 to which controller 18 optionally connects as well as supply 26 powering either or both of controllers 18 and 22. Although connections in the FIGURE are shown as wired, any or all of the connections (excluding power connections) may be wireless instead.

The foregoing is provided for purposes of illustrating, explaining, and describing embodiments of the present invention. Modifications and adaptations to these embodiments will be apparent to those skilled in the art and may be made without departing from the scope or spirit of the invention.

What is claimed is:

1. A method of deploying a valve actuator forming part of a water-recirculation system of a pool or spa, comprising:

a. communicatively coupling the valve actuator to an electronic controller;

b. thereafter determining transit time, between first and second positions, of a component of the valve actuator, the first and second positions defining maximum transit boundaries of the component during operation; and c. thereafter communicating from. the electronic controller to the component so as to stop transit of the component before elapse of the transit time and thereby permit corresponding water flow through the valve for circulation in the water-recirculation system of the pool or spa.

2. A method according to claim 1 further comprising connecting the electronic controller to a power center controller.

* * * * *